US011697535B2

(12) United States Patent
Falzoni et al.

(10) Patent No.: US 11,697,535 B2
(45) Date of Patent: Jul. 11, 2023

(54) CAP FOR A CONTAINER

(71) Applicant: SACMI COOPERATIVA MECCANICI IMOLA SOCIETA' COOPERATIVA, Imola (IT)

(72) Inventors: Alessandro Falzoni, Imola (IT); Paolo Vitali, Bologna (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 0 days.

(21) Appl. No.: 17/456,245

(22) Filed: Nov. 23, 2021

(65) Prior Publication Data

US 2022/0185554 A1 Jun. 16, 2022

(30) Foreign Application Priority Data

Dec. 11, 2020 (IT) ..... 102020000030608

(51) Int. Cl.
*B65D 55/16* (2006.01)
*B65D 41/34* (2006.01)

(52) U.S. Cl.
CPC ..... *B65D 55/16* (2013.01); *B65D 41/34* (2013.01); *B65D 41/3447* (2013.01); *B65D 2251/1008* (2013.01); *B65D 2401/30* (2020.05)

(58) Field of Classification Search
CPC ..... B65D 55/16; B65D 41/3428; B65D 2401/30; B65D 2251/1008
(Continued)

(56) References Cited

U.S. PATENT DOCUMENTS 6,474,491 B1 * 11/2002 Benoit-Gonin .... B65D 41/3428 220/263
8,123,056 B2 2/2012 Falzoni
(Continued)

FOREIGN PATENT DOCUMENTS

| | | | |
|---|---|---|---|
| EP | 2045192 | A1 | 4/2009 |
| WO | 2007085896 | A2 | 8/2007 |
| WO | 2020/041640 | A1 | 2/2020 |

OTHER PUBLICATIONS

Examination Report dated Aug. 5, 2022 in Indian Patent Application No. 202114054957, 5 pages.

*Primary Examiner* — James N Smalley
(74) *Attorney, Agent, or Firm* — Pearne & Gordon LLP; J. Gregory Chrisman

(57) ABSTRACT

Described is closing cap for a container comprising a lateral wall extending about an axis, a separation line being provided on the lateral wall to define a retaining ring, which comprises a retaining portion which extends up to a free edge of the retaining ring and is configured to engage internally with a ring for locking a neck of the container in such a way as to remain anchored to the neck, and a closing element removably engageable with the neck, so as to open or close the container rotating the closing element about the axis. The separation line is circumferentially interrupted to define in the lateral wall a joining zone in which the retaining ring and the closing element are joined. The cap comprises in addition an incision line, which is also provided on the lateral wall to define, in association with the separation line at least a first connecting band and a second connecting band for connecting together the joining zone and the retaining portion. The incision line comprises a pair of lateral stretches wherein a first lateral stretch defines, with a first part of the separation line, the first connecting band and a second lateral stretch defines, with a second part of the
(Continued)

separation line, the second connecting band. The lateral stretches differ in angular extension to define connecting bands of different lengths, the angular difference between the longest lateral stretch and the other lateral stretch being greater than or equal to 5° and less than or equal to 45°.

12 Claims, 8 Drawing Sheets

(58) Field of Classification Search
USPC ..... 215/306
See application file for complete search history.

(56) References Cited

U.S. PATENT DOCUMENTS

| | | | | |
|---|---|---|---|---|
| 10,654,625 | B2 * | 5/2020 | Migas | B65D 1/0246 |
| 2020/0399036 | A1 * | 12/2020 | Dai | B65D 41/325 |
| 2021/0094733 | A1 * | 4/2021 | Bloom | B65D 41/3409 |
| 2021/0221572 | A1 * | 7/2021 | Migas | B65D 41/3428 |
| 2021/0300648 | A1 * | 9/2021 | Bassi | B65D 55/16 |
| 2022/0073238 | A1 * | 3/2022 | Naumann | B65D 41/3428 |
| 2022/0106081 | A1 * | 4/2022 | Falzoni | B65D 1/0246 |
| 2022/0127048 | A1 * | 4/2022 | Oomori | B65D 55/16 |
| 2022/0169423 | A1 * | 6/2022 | Lohrman | B65D 55/16 |
| 2022/0194673 | A1 * | 6/2022 | Erwin | B65D 55/16 |
| 2022/0204228 | A1 * | 6/2022 | Bassi | B65D 55/16 |
| 2022/0204229 | A1 * | 6/2022 | Bassi | B65D 41/325 |

* cited by examiner

CAP FOR A CONTAINER

This invention relates to a cap for a container.

The invention relates to a cap provided with a retaining ring, which can be associated with a neck of the container, the cap being also provided with a closing element which, after opening, remains connected to the retaining ring.

The cap is particularly, but not exclusively, suitable for bottles designed to contain liquid substances.

There are prior art caps for bottles comprising a cup-shaped body provided with a lateral wall extending about an axis, which is provided with an inner thread designed to engage with an outer thread of a neck of the bottle. The prior art caps are also provided with a security ring connected to the cup-shaped body by means of a tear line provided with a plurality of breakable elements, for example breakable bridges. When the cap is unscrewed and is opened for the first time the cup-shaped body separates from the security ring along the tear line following breakage of the breakable bridges. The security ring remains associated with the neck of the bottle, whilst the cup-shaped body can be unscrewed by the user, which in this way separates the cup-shaped body from the bottle to access the contents of the bottle. Subsequently, the cup-shaped body can be re-screwed on the neck to reclose the bottle.

Sometimes, after the bottle has been emptied, the user throws the cup-shaped body on the ground, either intentionally or accidentally, whilst the bottle, together with security ring associated with it, should correctly be disposed of in a waste bin. This behaviour is obviously undesired.

To overcome this drawback, caps have been proposed provided with a separation line made in a lateral wall of the cap and interrupted circumferentially to form a retaining ring, configured to remain anchored to a neck of the container, and a closing element, which can be engaged in a removable fashion with the neck, so as to open or close the container. The separation line has two ends, that is, a first end and a second end, between which there is a joining zone which connects the closing element and the retaining ring. The retaining ring is provided with a retaining portion, which extends up to a free edge of the cap and is configured to engage internally with a locking ring of the neck. These caps comprise, in addition, an incision line also provided on the lateral wall to form, in association with the separation line two connecting bands positioned for connecting together the closing element and the retaining portion.

Between the two connecting bands, a first connecting band is formed between a first end part of the separation line, which extends from the first end of it, and a respective first lateral stretch of the incision line whilst a second connecting band is formed between a second end part of the separation line, which extends from the second end of it, and a respective first lateral stretch of the incision line. Each connecting band has a length which is determined by the angular extension of the respective lateral stretch of the incision line.

The closing element can be rotated between an open condition, in which a user can access the contents of the bottle, whilst the closing element is resting on the neck, and a closed condition, in which the closing element prevents access to the bottle. When the cap is in the open condition, there is an interference between the joining zone of the cap and the neck of the container which makes it difficult for the cap to rotate about the neck.

The connecting bands keep the closing element associated with the retaining ring and, therefore, with the bottle, preventing the closing element from being thrown onto the ground independently of the bottle and they must be robust, to prevent them from breaking due to use, and deformable, to allow the movement of the closing element relative to the neck in the open condition.

In fact, the connecting bands allow the closing element to be moved away from the retaining portion of the retaining ring, which remains anchored to a ring for locking the neck during the opening of the container, and allow the closing element to be tilted to make it rotate and rest on the neck.

The Applicant has found that the length of the connecting bands affects the stability of the locking of the closing element in the open condition and also on the ease with which the closing element can pass from the open condition to the closed condition, and vice versa.

In fact, if the connecting bands are short, they contribute to keeping the closing element stably anchored in position since they exert a pulling action towards the neck, thus reinforcing the interference between the joining zone and the neck, but make it difficult for a user to pass from the open condition to the closed condition, and vice versa.

On the other hand, in the case of long connecting bands, the user is facilitated in the opening and closing of the cap since, when opening, the closing element can easily be moved away from the neck of the container vertically and then rotated until it is to the open condition, and vice versa, when closing, move it away, inclined, from the neck of the container and rotate it again, placing it above the neck and returning it to the closed condition. However, in the open condition, it is only the interference between the joining zone and the neck of the container which keeps the closing element locked in the open condition, since the connecting bands are loose and do not exert any pulling action of the closing element towards the neck. The applicant has also carried out tests of use with connecting bands of intermediate length, between short and long, which, however, have not proved to solve the issue since they highlighted the same problems as the short and long connecting bands without the advantages.

The technical purpose of the invention is therefore to provide a cap for a container, particularly a cap comprising a retaining ring designed to remain associated with a neck of the container and a closing element which can engage in a removable fashion with the neck to allow a user to open or alternatively close the container, which is able to overcome the drawbacks of the prior art.

The aim of the invention is therefore to provide a cap for a container provided with a retaining ring, a closing element and two connecting bands, positioned between the closing element and a retaining portion of the retaining ring, wherein the connecting bands operate in conjunction in keeping the closing element stably locked in the open condition and at the same time guarantee an easy movement from the open condition to the closed condition.

The technical purpose indicated and the aims specified are substantially achieved by a cap for a container comprising the technical features described in one or more of the appended claims. The dependent claims correspond to possible embodiments of the invention.

In particular, the technical purpose and aims specified are substantially achieved by a closing cap for a container, comprising a lateral wall extending about an axis and a transversal wall located at an end of the lateral wall, a separation line being provided on the lateral wall to form a retaining ring, which comprises a retaining portion extending up to a free edge of the retaining ring and is configured for engaging internally with a ring for locking a neck of the container in such a way as to remain anchored to the neck, and a closing element which can be engaged in a removable fashion with the neck, so as to open or close the container rotating the closing element about the axis; the separation line being circumferentially interrupted to define in the lateral wall a joining zone in which the retaining ring and the closing element are joined; the cap comprising in addition an incision line, also provided on the lateral wall to define, in association with the separation line at least a first connecting band and a first connecting band, for connecting together the joining zone and the retaining portion; wherein the incision line comprises a pair of lateral stretches wherein a first lateral stretch defines, with a first part of the separation line which extends from a first end of the separation line, the first connecting band and a second lateral stretch defines, with a second part of the separation line which extends from a second end of the separation line the second connecting band; wherein the lateral stretches have a different angular extension to define connection bands with different lengths, the angular difference between the longer lateral stretch and the other lateral stretch being greater than or equal to 5° and less than or equal to 45°.

Thanks to the fact that the connecting bands are of different length, when passing to the open condition, as the closing element gradually moves away from the retaining portion, the first connecting band and the second connecting band move away both from the closing element and from the retaining portion, remain joined to each other in the joining zone and adopt a shape like that of a scalene trapezium.

Thanks to the fact that between the two connecting bands, defined by lateral stretches of the incision line, there is an angular difference which is greater than 10° and less than 45°, the user is facilitated in moving the closing element away from the security ring in the opening passage, or moving it close in the closing passage, moving the closing element laterally and exploiting the greater length of one of the two connecting bands.

The user can thus easily move the closing element away from the neck of the container and then rotate it to rest it on the neck, moving it from the same side of the shorter connecting band and at the same time can also easily disengage the closing element from the neck and move it aligned above the neck to engage it again.

At the same time, it is sufficient to have a shorter connecting band, and with the angular difference in the above-mentioned interval, so that it applies a pulling action of the closing element towards the neck, thereby reinforcing the interference between the joining zone and the neck and keeping the closing element stably locked on the neck in the open condition.

In other words, the presence of asymmetrical connecting bands with the angular difference in the above-mentioned range has the same advantages as having both the connecting bands short, or long, but not having the drawbacks.

According to a version, the connecting band positioned in the direction of opening is longer. Thanks to this version, the user is facilitated in the rotation in the direction of opening, that is, in the passage to the open condition.

According to an alternative version, the connecting band positioned in the direction of closing is longer. Thanks to this other version, the user is, on the other hand, facilitated in the rotation in the closed direction, that is, in the passage to the closed condition.

The invention can be better understood and implemented with reference to the accompanying drawings which illustrate non-limiting example versions of it and in which:

FIG. 1 is a side view of a closure cap for a container, according to the invention, which comprises a separation line and an incision line for defining a closing element, a retaining ring and two connecting bands, formed between the incision line and the separation line, which are of different lengths, the longer connecting band being that located in a direction of opening of the cap and wherein the cap comprises a tab interposed between the two connecting bands, a central stretch of the incision line, designed to make the bottom edge of the tab, being aligned with lateral stretches of the incision line;

Figure 1:
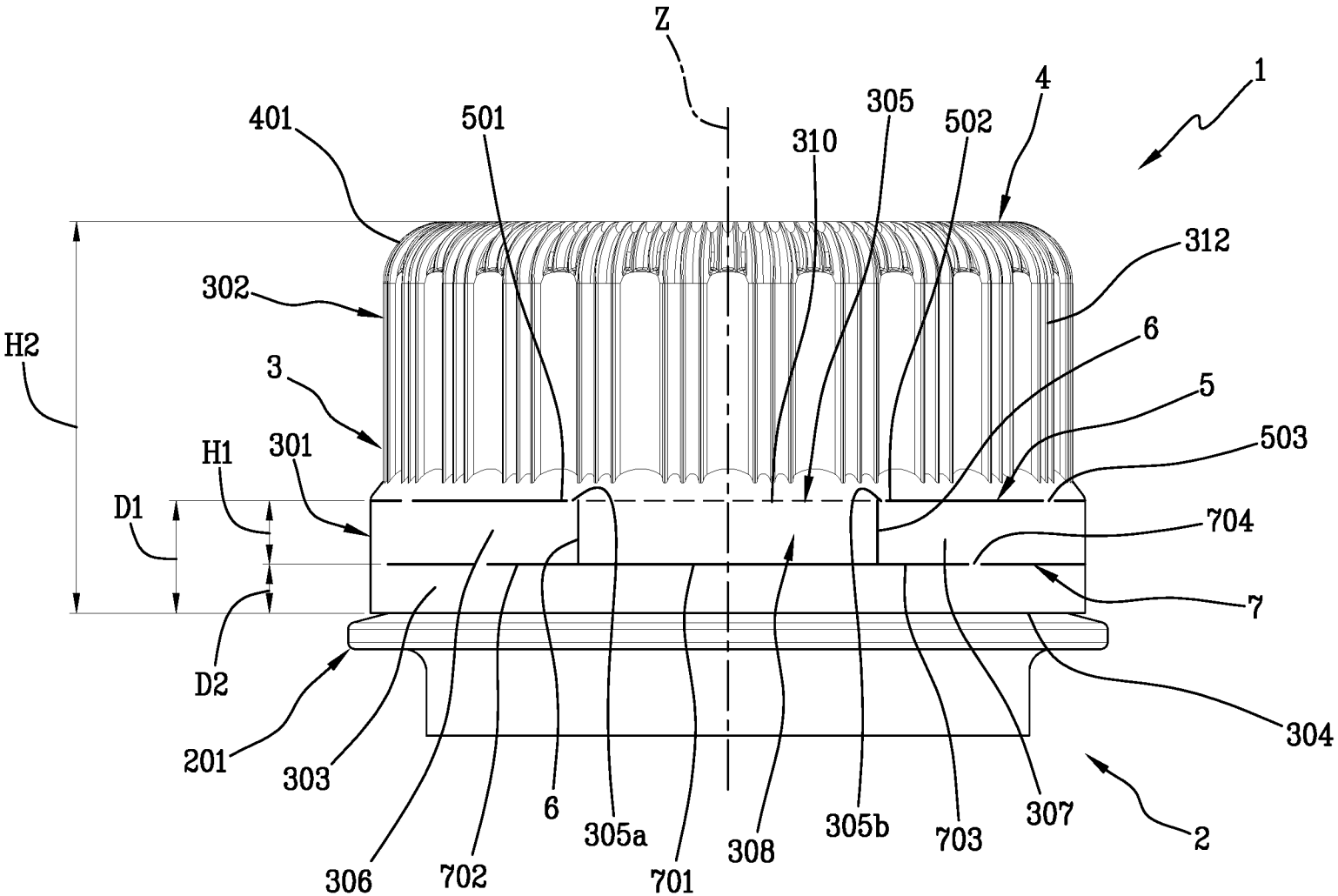

With reference to FIGS. 1 to 5, the numeral 1 denotes a cap for closing a container 2, of which only a neck 201 is shown in detail, particularly a bottle designed to contain a liquid substance such as a drink.

It should be noted that elements common to the different embodiments will be indicated with the same reference numerals.

The cap 1 is made of polymeric material. Any polymeric material designed to be moulded can be used to obtain the cap 1.

The cap 1 is shown in FIG. 1 in a closed condition in which the cap 1 is located when it leaves a cap production line and is applied to the neck 201 of the container 2, in combination with it.

In this condition, the cap 1 comprises a lateral wall 3 which extends about an axis Z, and a transversal wall 4 located at an end of the lateral wall 3, so as to close the end. The transversal wall 4 extends transversally, in particular perpendicularly, to the axis Z. The transversal wall 4 may be flat, even though other shapes are theoretically possible. In the example illustrated, the transversal wall 4 has a substantially circular shape in plan view.

The axis Z is a central axis of symmetry for the cap 1.

The lateral wall 3 and the transversal wall 4 define a cup-shaped body, designed to receive an end portion of the neck 201 of the container 2, so that the cap 1 can close the container 2.

More specifically, the lateral wall 3 is connected to the transversal wall 4 by a connecting zone 401, which may be shaped, in cross section, like a bevelled edge or a circular connector.

The cap 1 comprises a separation line 5, which is provided on the lateral wall 3 to define a retaining ring 301, which is configured to remain anchored to the neck 201 of the container 2.

Figure 4:
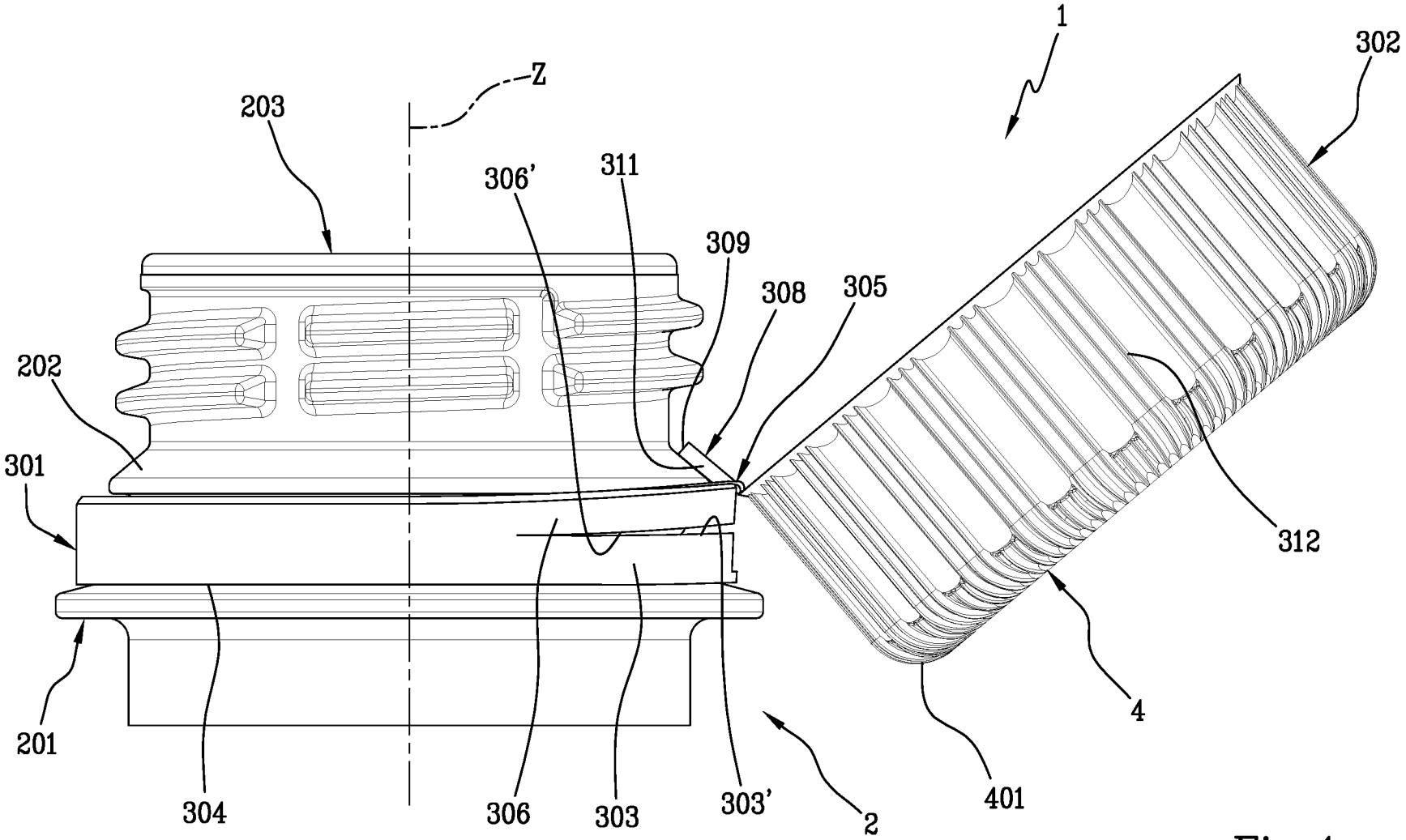
FIG. 4 is a side view of the cap of FIG. 1 in an open configuration, wherein the closing element is spaced from a neck of the container and the tab is locked resting on the neck, close to a ring for locking the neck, on the side in which the shorter connecting band is shown.
Figure 5:
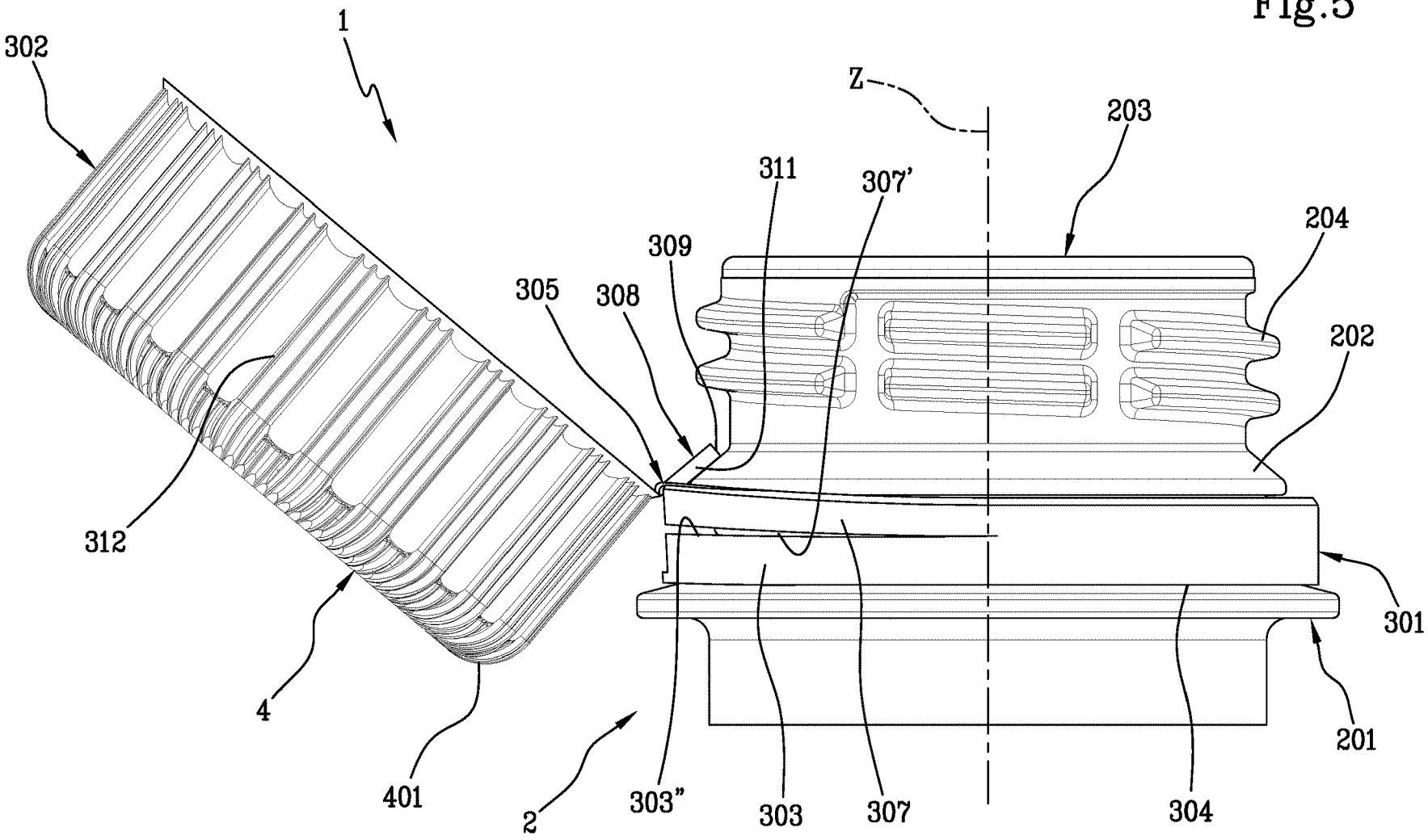
FIG. 5 is another side view of the cap of FIG. 1 in the open configuration, from the side showing the longest connecting band.

More in detail, the retaining ring 301 is configured to engage internally with a locking ring 202, shown at least in FIGS. 4 and 5, which projects from an outer surface of the neck 201, in such a way as to remain anchored to the neck 201.

The locking ring 202 is an annular enlargement, which extends in a plane positioned transversally to the axis Z.

The separation line 5, on the lateral wall 3, defines, in addition to the retaining ring 301, a closing element 302 which can be removably engaged with the neck 201, so as to open or close the container 2 rotating the closing element 302 about the axis Z. The closing element 302 can be engaged for closing a dispensing opening 203 of the container 2.

The separation line 5 extends about the axis Z and is circumferentially interrupted so as to define in the lateral wall 3 a joining zone 305, in which the retaining ring 301 and the closing element 302 are joined. More in detail, the separation line 5 extends between a first end 501 and a second end 502.

The separation line 5 may have an angular extension, about the axis Z, greater than or equal to 240° and less than, or equal to, 350°.

According to a version, the angular extension of the separation line 5 may be between 250° and 340°.

It should be noted that the expression "the angular extension is between" 250° and 340° means, in all this document, that it may be greater than, or equal to, 250° and less than, or equal to, 340°, in other words, the ends of the range indicated are always included therein and are not excluded.

The retaining ring 301 comprises a retaining portion 303, which is configured to engage internally with the locking ring 202 and extends up to a free edge 304 of the retaining ring 301.

The free edge 304 delimits the retaining ring 301, and therefore the cap 1, on the side opposite the transversal wall 4. The retaining ring 301 therefore extends between the separation line 5 and the free edge 304 and may be delimited by a cylindrical or truncated cone shaped outer surface. Preferably, the separation line 5 is parallel to the free edge 304.

In other words, the retaining portion 303 is a lower portion of the retaining ring 301, and therefore of the cap 1, when the cap is joined to the container 2 and is configured to retain anchored the retaining ring 301 to the neck 201 of the container 2.

The lateral wall 3 can be provided, on a relative outer surface, with a plurality of knurling lines 312, extending parallel to the axis Z and designed to facilitate gripping of the cap 1 by the user or by the capping machine which applies the cap 1 on the container to be closed.

The knurling lines 312 may be positioned in the closing element 302 but may also continue in the connecting zone 401 and/or in the retaining ring 301.

In the example shown in FIGS. 1 to 5, it should be noted that the lateral wall 3 comprises a cylindrical portion extending up to the connecting zone 401, on which the knurling lines 312 are made, a wide portion with a diameter greater than the cylindrical portion, which extends up to the free edge 304 of the retaining ring 301 and a connecting portion positioned between the cylindrical portion and the wide portion. The knurling lines 312 are provided on the connecting surface but not in the wide portion, which is externally delimited by a smooth outer surface, that is to say, it may be free of knurling lines 312. This is not, however, necessary, since the knurling lines 312 might also extend on the wide portion.

The cap 1 comprises an incision line 7, also provided on the lateral wall 3 for defining, in association with the separation line 5 at least one pair of connecting bands, that is, a first connecting band 306 and a second connecting band 307 for connecting together the joining zone 305 and the retaining portion 303.

More in detail, the incision line 7 comprises a pair of lateral stretches, wherein a first lateral stretch 702 defines, with a first part of the separation line 5 which extends from a first end 501 of the separation line 5, the first connecting band 306 and a second lateral stretch 703 defines, with a second part of the separation line 5 which extends from a second end 502 of the separation line 5, the second connecting band 307.

The first connecting band 306 and the second connecting band 307 therefore extend from circumferentially opposite end portions of the joining zone 305 and are therefore positioned circumferentially on the opposite side relative to it.

As described in more detail below, different variants of the cap 1 can be identified in relation to the position and the shape of the incision line 7 relative to the separation line 5.

The separation line 5 and the incision line 7 can be made as cut lines by means of a cutting operation on a concave body obtained by moulding.

The incision lines may pass through the entire thickness of the lateral wall, or not passing through, if the thickness of the lateral wall is to be cut only partly.

Preferably, the separation line 5 and the incision line 7 are made by cuts passing through an entire thickness of the lateral wall.

Preferably, along the separation line 5 there may be a plurality of breakable bridges 503, whilst along the incision line 7, there may be a plurality of breakable elements 704, the breakable bridges 503 and breakable elements 704 being designed to break the first time the cap 1 is opened. The breakable elements 704 may be positioned in positions angularly offset about the axis Z relative to the breakable bridges 503.

Preferably, the breakable bridges 503 are provided both along the separation line 5 and also on the incision line 7 but, optionally, the incision line 7 may be free of breakable elements.

It should be noted that the incision line 7 has an angular extension, measured about the axis Z, greater than the angular distance (also measured about the axis Z) between the first end 501 and the second end 502 of the separation line 5, that is to say, the angular extension of the joining zone 305. In addition, the joining zone 305 extends circumferentially in the angular extension of the incision line 7.

The first lateral stretch 702 and the second lateral stretch 703 of the incision line 7 are both perpendicular to the axis Z and are aligned. However, according to a version not illustrated, the two lateral stretches 702 and 703 might be slightly inclined relative to each other and have different inclinations, not necessarily parallel to each other.

The first lateral stretch 702 and the second lateral stretch 703 extend, preferably, on a first plane (not illustrated) parallel to a separation plane (not illustrated) containing the separation line 5, the first plane being transversal to the axis Z, in particular perpendicular to the axis Z.

As mentioned above, the retaining ring 301 is configured to engage internally with the locking ring 202 in such a way as to remain anchored to the neck 201.

Figure 3:
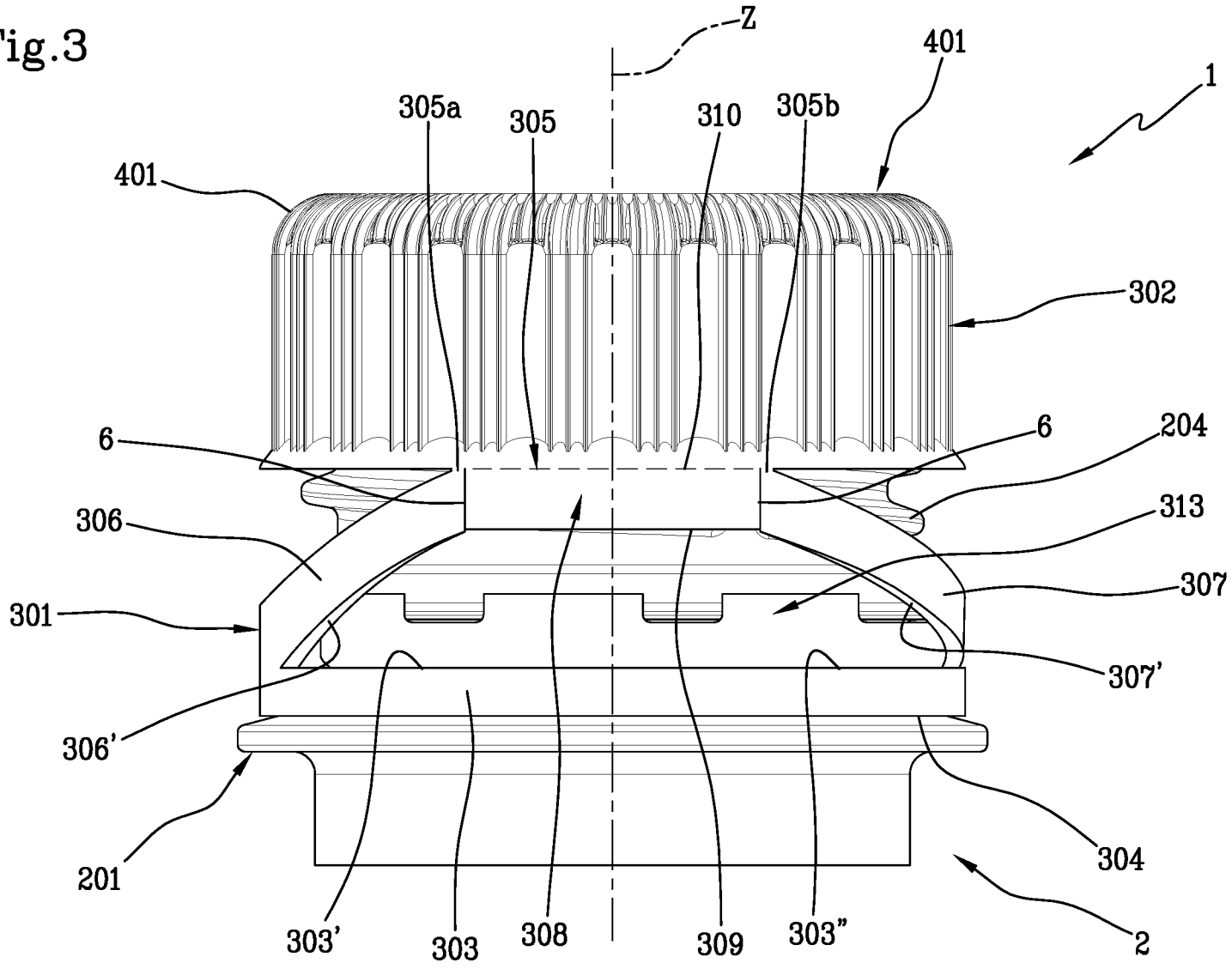
FIG. 3 is the side view of the cap of FIG. 1, in a final open condition, wherein the closing element of the cap is almost completely separated from the retaining ring.

For this purpose, as shown in FIG. 3, the retaining ring 301 is provided internally with an engagement element 313, designed to engage with the locking ring 202. The engagement element 313 is configured for making contact against the locking ring 202 so as to prevent axial movements of the retaining ring 301, away from the neck 201, when the closing element 302 is moved away from the neck 201.

More in detail, it is the retaining portion 303 of the retaining ring 301 to be provided with the engagement element 313, in such a way as to be retained anchored to the locking ring 202 even when the closing element 302 is in the open condition and is locked spaced from the neck 201 and from the dispensing opening 203 of the neck 201.

The engagement element 313 is shaped like an annular element which is folded around the free edge 304 towards the inside of the retaining portion 303. More in detail, the annular element may be continuous or interrupted. In effect, there may be a plurality of folded elements, shown in FIG. 3, shaped like tabs, which project from the free edge 304 and are folded towards the inside of the retaining portion 303 for making the engagement element. Alternatively, according to a version not illustrated, the engagement element 313 may be shaped like a continuous or interrupted enlargement, which from an inner surface of the retaining portion 303 projects towards the axis Z to engage with the locking ring 202.

As shown at least in FIGS. 3, 4 and 5, the cap 1 comprises, in addition, a coupling structure, or thread, not illustrated, positioned inside the lateral wall 3 and configured for removably couple the closing element 302 to the neck 201 of the container 2, in such a way that the cap 1 can be moved from the closed condition, wherein the cap 1 closes the dispensing opening 203 of the container 2, to the open condition.

The coupling structure of the cap 1 is positioned inside the closing element 302 and is shaped to engage with a corresponding coupling structure 204 present externally on the neck 201 of the container 2 for removably coupling the closing element 302 to the neck 201 of the container 2.

The coupling structure of the closing element 302 and the coupling structure 204 of the neck 201 are, as illustrated in the accompanying drawings, made as a thread.

In this case, the movement from the closed condition to the open condition is performed by a rotation of the closing element 302 relative to the neck 201 of the container 2 in a direction of opening whilst, vice versa, the movement from the open condition to the closed condition is performed by a rotation in a closed direction, which is opposite to the direction of closing. The direction of opening is, generally, anti-clockwise.

According to the invention, the lateral stretches 702 and 703 have a different angular extension to define connecting bands 306 and 307 of different lengths. In effect, the length of the lateral stretches 702 and 703 of the incision line 7 directly determine the length of the connecting bands 306, 307, extending the separation line 5 substantially all around the cap 1, except in the joining zone 305.

The incision line 7 has a centre line which does not coincide with a centre line of the joining zone 305.

Advantageously, the angular difference between the longer lateral section 702, or 703, and the other lateral stretch 703, or 702, is greater than or equal to 5° and less than or equal to 45°.

Thanks to this angular difference between the lateral stretches 702, 703 of the incision line 7, the Applicant has verified by experimental tests that the connecting bands 306, 307 are of such length that the movement is facilitated of the closing element 302 in the open condition and vice versa, in the closed condition, and at the same time the closing element 302 is allowed to stably lock on the neck 201 of the container 2 when the cap 1 is in the open condition, preventing any rotational movement of the closing element 302, both towards the dispensing opening 203 and around the neck 201 of the container 2. The closing element 302 cannot, therefore, fall by gravity since the shorter connecting band pulls the closing element 302 moving it towards the neck 201 and holds it locked.

Preferably, the angular difference between the longest lateral stretch 702, or 703, and the other lateral stretch 703, or 702, is greater than, or equal to 10° and less than, or equal to 30°.

With this preferred angular difference between the lateral stretches 702, 703, the Applicant has found that the connecting bands 306, 307 determined by them have a length such as to guarantee the maximum effectiveness of the above-mentioned technical effect.

Figure 2:
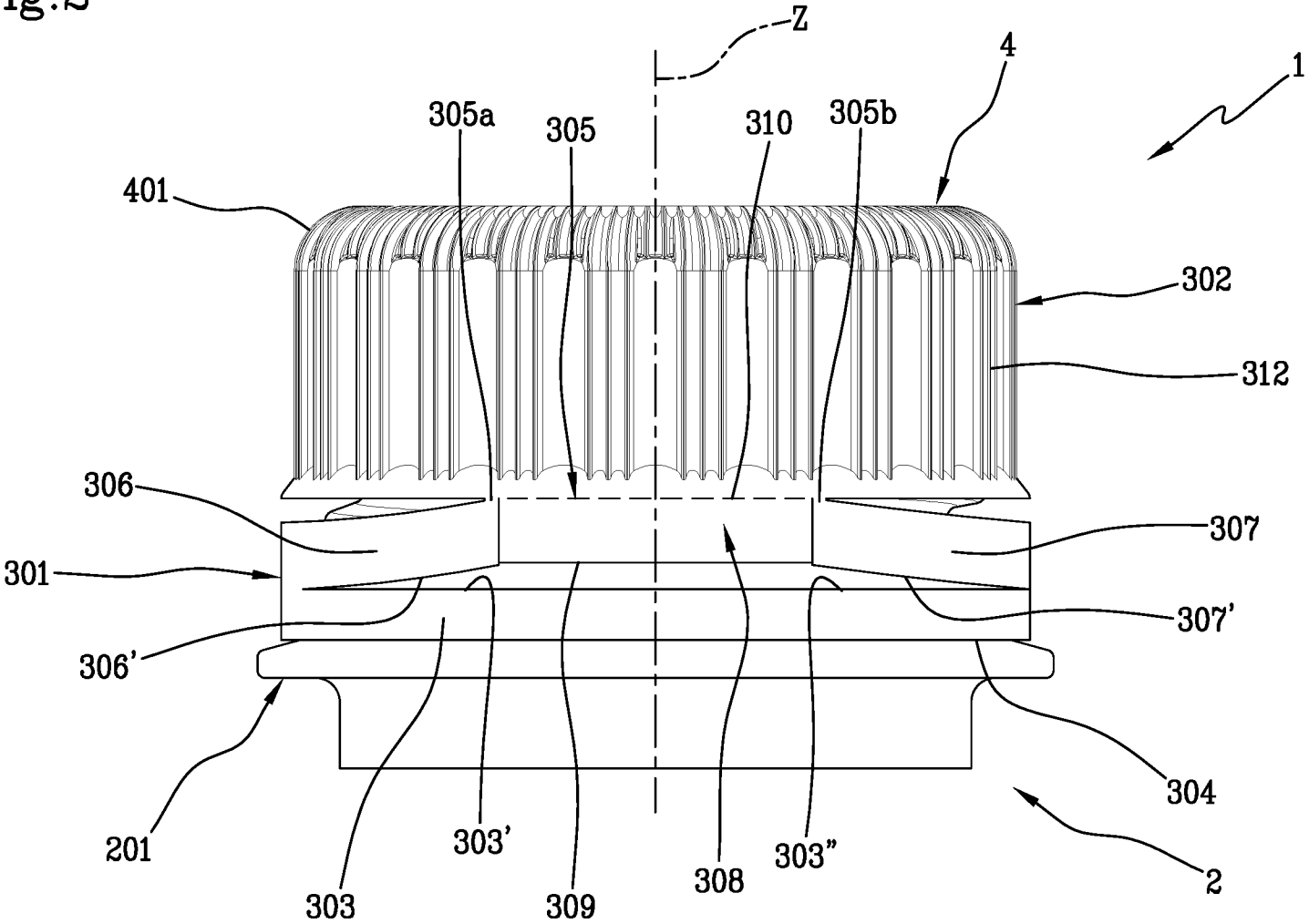
FIG. 2 is the side view of the cap of FIG. 1, in an initial open condition, wherein the closing element of the cap starts to be separated from the retaining ring.

As illustrated in FIGS. 2 and 3, the longer connecting band is the second connecting band 307, which is the one located in the direction of opening, if the direction of opening is anticlockwise and the direction of closing is clockwise. With this configuration of the connecting bands 306, 307, the passage from the closed condition to the open condition is facilitated since, between the two connecting bands 306, 307, the tension in the direction of opening is less.

Vice versa, according to a version not illustrated, the longer connecting band may be that located in the direction of closing, that is to say, the first connecting band 306.

With this configuration of the connecting bands 306, 307, the passage from the open condition to the closed condition is facilitated since, between the two connecting bands 306, 307, the tension in the direction of closing is less.

As shown in FIGS. 1 to 5, the incision line 7 is positioned between the separation line 5 and the free edge 304.

When the cap 1 is in the open condition, as shown at least in FIG. 3, the first lateral stretch 702 and the second lateral stretch 703 respectively define a first free lower edge 306' and a second free lower edge 307' of the connecting bands 306, 307.

In addition, the first lateral stretch 702 and the second lateral stretch 703 also define a first free upper edge 303' and a second free upper edge 303" of the retaining portion 303.

The separation line 5 is positioned at a distance D1 from the free edge 304 of the retaining ring 301. The height of the retaining ring 301 along an axis parallel to the axis Z is therefore equal to D1.

The first lateral stretch 702 and the second lateral stretch 703 are positioned at the distance D2 from the free edge 304 of the retaining ring 301, along an axis parallel to the axis Z, which corresponds to the height of the retaining portion 303.

H1 denotes a height of the connecting bands 306 and 307, along an axis parallel to the axis Z, when the closing element 302 is in the closed condition.

If the separation line 5 and the incision line 7 are parallel to each other and perpendicular to the axis Z, the height H1 of the connecting bands is given by the axial distance between the separation line 5 and the incision line 7. H2 denotes a height of the cap 1, measured between the transversal wall 4 and the free edge 304.

As shown in FIGS. 1 to 5, the retaining ring 301 comprises a tab 308 so that when the closing element 302 is in an open condition and the connecting bands 306, 307 keep the closing element 302 connected to the retaining ring 301, the tab 308 can rest on the neck 201 (FIGS. 4 and 5). The incision line 7 comprises a central stretch 701, which is interposed between the first lateral stretch 702 and the second lateral stretch 703 of the incision line 7, and which defines a bottom edge 309 configured to face, when the cap 1 is in the open condition, towards the neck 201, or towards the dispensing opening 203, of the container 2. The central stretch 701 in the closed condition faces, on the other hand, the retaining portion 303. This bottom edge 309 is the bottom edge of the tab 308.

There are two cuts 6 on the lateral wall 3 which define the respective lateral edges 311 of the tab 308, when the cap is in the open condition, and are made by cutting lines passing through the entire thickness S of the lateral wall 3.

The cuts 6, shown in FIG. 1, extend parallel to each other and parallel to the axis Z and are therefore perpendicular to the bottom edge 309 of the tab 308.

If the lateral edges 311 of the tab 308 are curved, the cuts 6 from which it is possible to obtain the lateral edges 311 are also curved.

The central stretch 701 of the incision line 7 is positioned between the cuts 6 and is also interposed between the first lateral section 702 and the second lateral section 703 of the incision line.

As shown in FIG. 1, the central section 701 and the two lateral stretches 702 and 703 are aligned with each other and in the single plane positioned transversally, in particular perpendicularly, to the axis Z.

In this case, the bottom edge 309 of the tab 308 is aligned with the connecting bands 306 and 307.

More in detail, the bottom edge 309 is aligned with the first free lower edge 306', and with the second free lower edge 307', of the connecting bands 306, 307.

Considering a height H of the tab 308, this is determined by the height of the cuts 6.

It should be noted that the tab 308 is circumferentially interposed between the first connecting band 306 and the second connecting band 307 and that, in the initial open condition of FIG. 2 and in the final open condition of FIG. 3, thanks to the connecting bands 306, 307, connected to the joining zone 305, the closing element 302 can rotate relative to the neck 201 of the container 2 about the joining zone 305, which defines in this way a hinge band which keeps the closing element 302 connected relative to the neck 201, deforming.

The joining zone 305, the first connecting band 306, the second connecting band 307 and the tab 308 are joined together and define a hinge arrangement which has a capacity of movement, in an axial direction, considerably greater than the capacity of movement which would be allowed only by the single joining zone 305.

In fact, the first connecting band 306 and the second connecting band 307 can be spaced both from the closing element 302 and from the retaining portion 303 and remain joined to each other in the joining zone 305.

The first connecting band 306 and the second connecting band 307 can thus adopt a shape like a trapezium shown in FIG. 2 and FIG. 3 and it may be noted that the tab 308 is positioned centrally, in the smaller base of the trapezium. Having the connecting bands 306, 307 different in length, and in detail as the second connecting band 307 placed in the direction of opening (on the right, looking at the front of the cap) is longer than the first connecting band 306, they adopt the shape of a scalene trapezium.

After disengaging from the neck 201, the closing element 302 may be rotated about the joining zone 305 and when the cap 1 is in the open condition of FIGS. 4 and 5, the tab 308 can rest on the neck 201 for locking the closing element 302 spaced from the neck 201.

During the rotation about the joining zone 305, the user will be encouraged to move the closing element 302 towards the left before rotating it and resting it on the neck 201, that is, towards the first connecting band 306, which is the shorter one.

The hinge arrangement is a part of the retaining ring 301 which is interposed between the retaining portion 303 of the retaining ring 301 and the closing element 302.

It should be noted that the tab 308 is connected to the lateral wall 3 by a hinge line 310, about which the tab 308 can optionally bend for resting on the neck 201 close to the locking ring 202.

It should be noted that the hinge line 310 is a virtual line which defines in the lateral wall 3 a zone about which the tab 308 may optionally bend, which may also be part of the hinge band of the joining zone 305, relative to the height H of the tab 308, or positioned closer to the free edge 304, or also on the lateral wall 3, as described in more detail below.

The bottom edge 309 is a free edge positioned on the opposite side relative to the hinge line 310.

The cuts 6 have the same height and have upper ends, facing towards the transversal wall 4, between which the hinge line 310 is defined. The cuts 6 have lower ends, between which is defined the first stretch 701 of the incision line 7.

In the cap 1 of FIGS. 1 to 5, the hinge line 310 is close to the separation line, in particular is substantially aligned with the separation line 5.

When the closing element 302 passes from the closed condition to the open condition, as shown in FIGS. 4 and 5, the joining zone 305 can deform so as to be tilted relative to the neck 201, so that the bottom edge 309 can rest on the neck 201.

The hinge band comprises a first hinge element 305*a* and a second hinge element 305*b* defined at least partly in the joining zone 305, respectively, between the first end 501 and the second end 502 of the separation line 5 and the respective upper ends of the cuts 6, that is, the ends of the hinge line 310.

The first hinge element 305*a* and the second hinge element 305*b* are positioned at the sides of the tab 308 and are configured to deform in the open condition.

The deformation affects exclusively the first hinge element 305*a* and the second hinge element 305*b* but not the connecting bands 306, 307, which can therefore remain substantially undeformed and do not twist in the open condition.

Advantageously, in the open condition the tab 308 may rest on the neck 201 in the proximity of the locking ring 202.

In effect, with regard to the shape of the retaining ring 301 and/or of the locking ring 202 and/or of the tab 308 and/or of the connecting bands 306 and 307, the inclination of the closing element 302 relative to the neck 201 is determined, which in turn determines the resting of the tab 308 on the neck 201, as shown in FIGS. 4 and 5. Since the first connecting band 306 is shorter than the second connecting band 307, it will apply a pulling action on the closing element 302 which is able to keep the first hinge element 305*a* and the second hinge element 305*b* stably moved towards the neck 201.

It should be noted that in FIGS. 1 to 3 that the first hinge element 305*a* and the second hinge element 305*b* are shown as having a same angular extension about the axis Z.

However, preferably, according to a version not illustrated, the first hinge element 305*a* and the second hinge element 305*b* have a different circumferential angular extension since the hinge element 305*a*, or 305*b* adjacent to the connecting band 306, or 307 shorter, extends about the angle Z for an angle greater than that of the other hinge element 305*b*, or 305*a*.

If the first connecting band 306 is shorter than the second connecting band 307, then the first hinge element 305*a* extends angularly more than the second hinge element 305*b*; or vice versa, if the second connecting band 307 is shorter than the first connecting band 306, then the second hinge element 305*b* extends angularly more than the first hinge element 305*a*.

In fact, the shorter connecting band between the first connecting band 306 and the second connecting band 307 applies a pulling action on the closing element 302 which stresses the hinge element, respectively the first hinge element 305*a*, or the second hinge element 305*b*, adjacent to it. Thanks to the fact that the hinge element 305*a*, or 305*b*, has an angular extension greater than that of the other 305*b*, or 305*a*, a robustness of the hinge element 305*a*, or 305*b* more stressed is guaranteed. This allows the user to use the cap 1 with numerous cycles of passage from the open condition to the closed condition, and vice versa, without the hinge element 305*a* or 305*b* weakening and breaking.

Considering the separation plane, the different angular extension between the first hinge element 305*a* and the second hinge element 305*b* determines a respective difference in length between them.

Experimental tests carried out by the Applicant have shown that, advantageously, the technical effect is achieved more if said difference in length between the first hinge element 305*a* and the second hinge element 305*b* is greater than or equal to 0.10 mm and is less than or equal to 0.20 mm, and is preferably equal to 0.15 mm.

Figure 6:
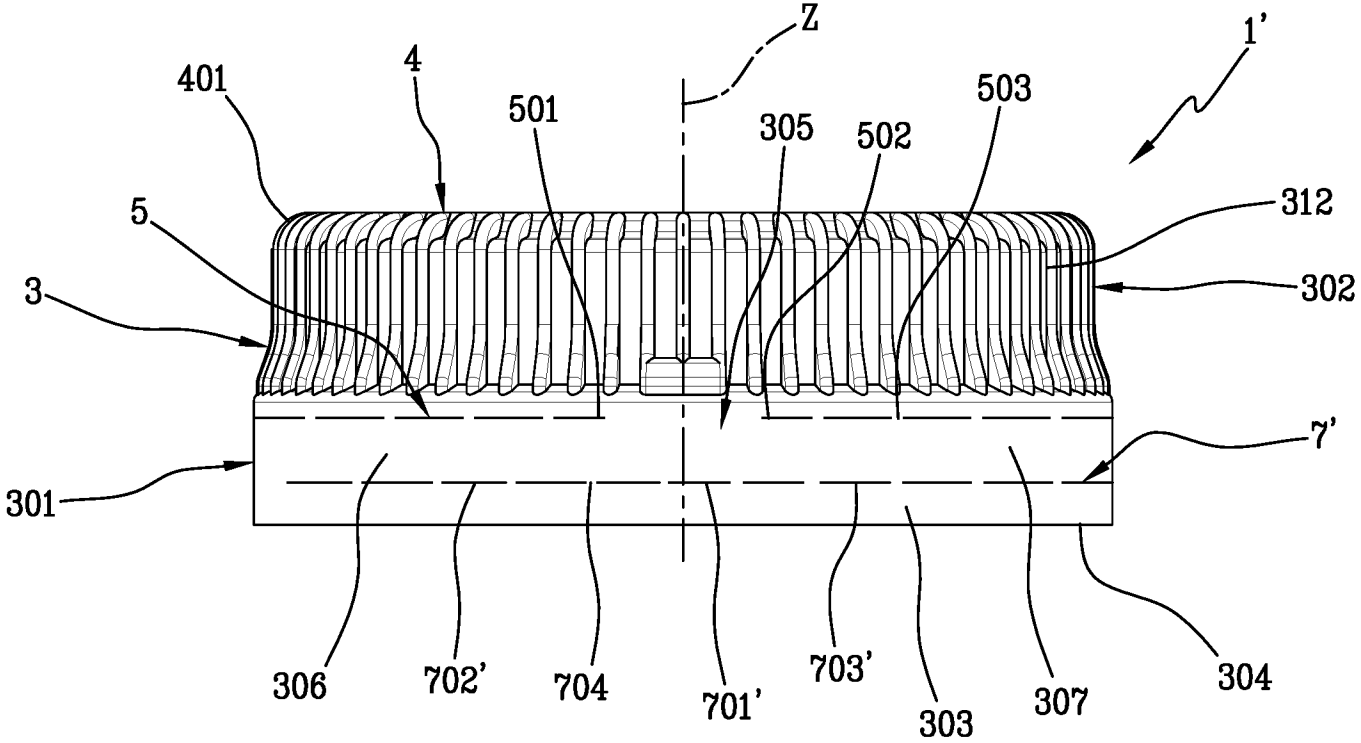
FIG. 6 is a side view of a version of the cap of FIG. 1, wherein the tab is absent, which comprises a separation line and an incision line to define a closing element, a retaining ring and two asymmetrical connecting bands, formed between the incision line and the separation line, wherein the longest connecting band is the one located in the direction of opening of the cap.

According to a variant 1' of the cap shown in FIG. 6, the tab is absent as there are no cuts 6 and the cap 1' comprises an incision line 7' provided with a central stretch 701', and lateral stretches 702' and 703'.

The fact remains valid that the central stretch 701' of the incision line 7, interposed between the first lateral stretch 702' and the second lateral stretch 703', defines a bottom edge configured to be facing, when the cap 1 is in the open condition, towards the neck 201, or towards the dispensing opening 203, of the container 2. The central stretch 701' faces the joining zone 305.

What has been said above for the cap 1 applies for the cap 1' of FIG. 6, with reference to the connecting bands 306 and 307, which have a different length and for which there is the above-mentioned angular difference between the lateral stretches 702', 703' of the incision line 7'.

However, unlike the cap 1, in the cap 1' the connecting bands 306 and 307 can deform when the closing element is in the open condition.

If, in fact, in each connecting band 306, 307, a first strip is considered facing towards the closing element 302 and a second strip facing towards the free edge 304, the first strip may expand radially, without being subjected to substantial twisting whilst the second strip may, on the other hand, be twisted to pass under the first strip, interposing between the first strip and the outer surface of the neck 201. In that way, when the bottom edge of the first stretch 701' is positioned towards the dispensing opening 203 of the container 2, the second strip of the connecting bands 306 and 307 is twisted and is under the first strip. This twisting acts in conjunction with the different length of the connecting bands 306, 307 to keep stably fixed in the same position the closing element 302 in the open condition.

Figure 7:
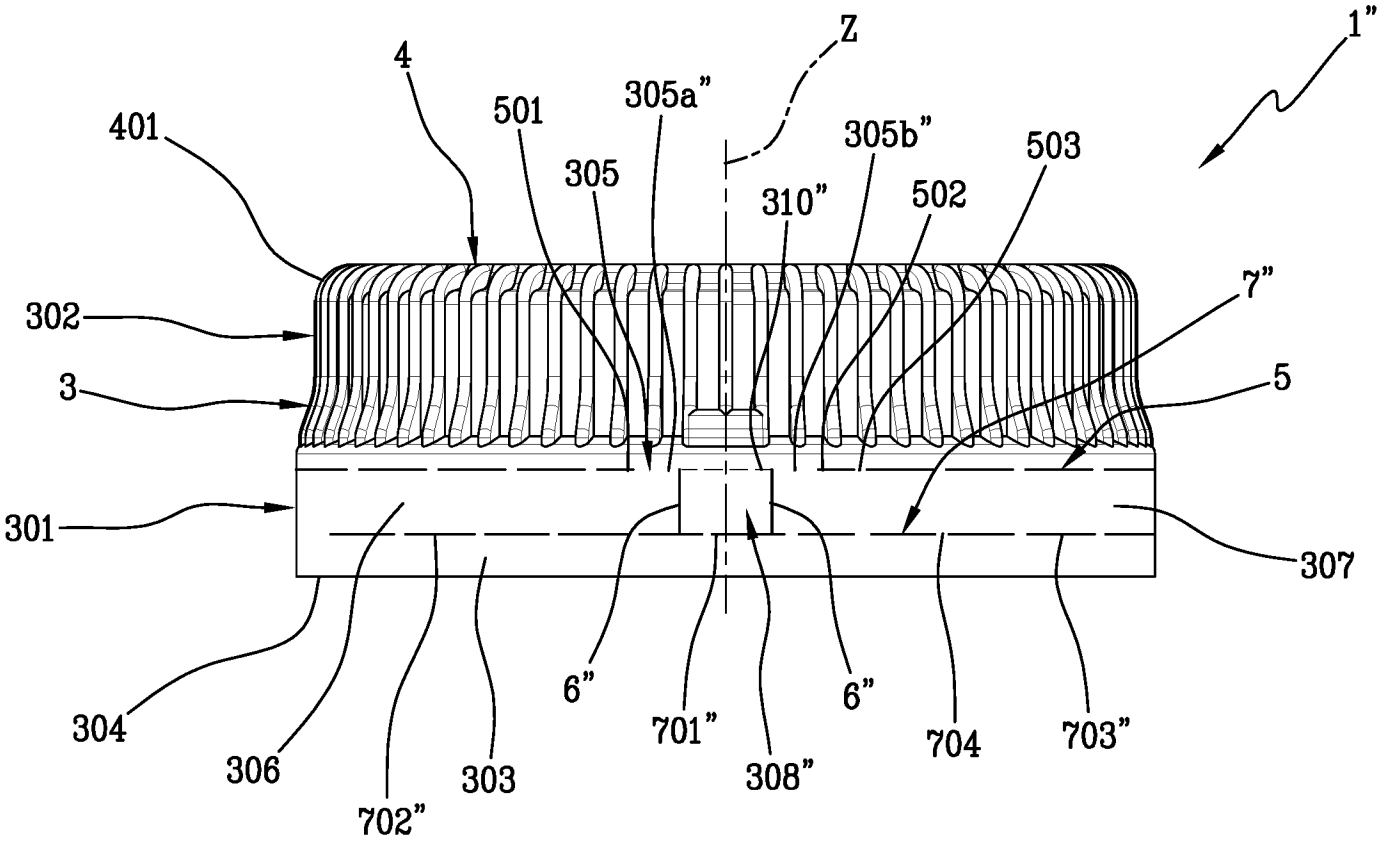
FIG. 7 shows a side view of a different version of the cap of FIG. 6, wherein there are the two asymmetrical connecting bands and wherein there is a tab interposed between the two connecting bands, a central stretch of the incision line, designed to form the bottom edge of the tab, being aligned with the lateral stretches of the incision line, as in the cap of FIG. 1.

According to a variant 1" of the cap shown in FIG. 7, the above applies to the cap 1, since the cap 1" comprises an incision line 7" in which there is a first stretch 701" which is aligned with the lateral stretches 702" and 703" and defines a tab 308" aligned with the connecting bands 306, 307 together with the cuts 6".

It should be noted, however, that the cuts 6", for angular positioning about the axis Z, define a first hinge element 305*a*" and a second hinge element 305*b*" which are more extended angularly, and hence like surfaces, of the hinge elements 305*a*, 305*b* of the cap of FIG. 1.

What is said above for the cap 1 also applies for the hinge elements 305*a*", 305*b*", and that is to say, it is advantageous that the hinge element 305*a*", or 305*b*" adjacent to the connecting band 306, or 307 shorter than the other, is angularly larger than the axis Z.

The angular extension of the tab 308" is less than the angular extension of the tab 308 but, in the same way as for the cap 1, also in the cap 1" there is a hinge line 310", substantially aligned with the separation line 5.

In other words, the upper ends of the cuts 6 are substantially aligned with the separation line 5.

Figure 8:
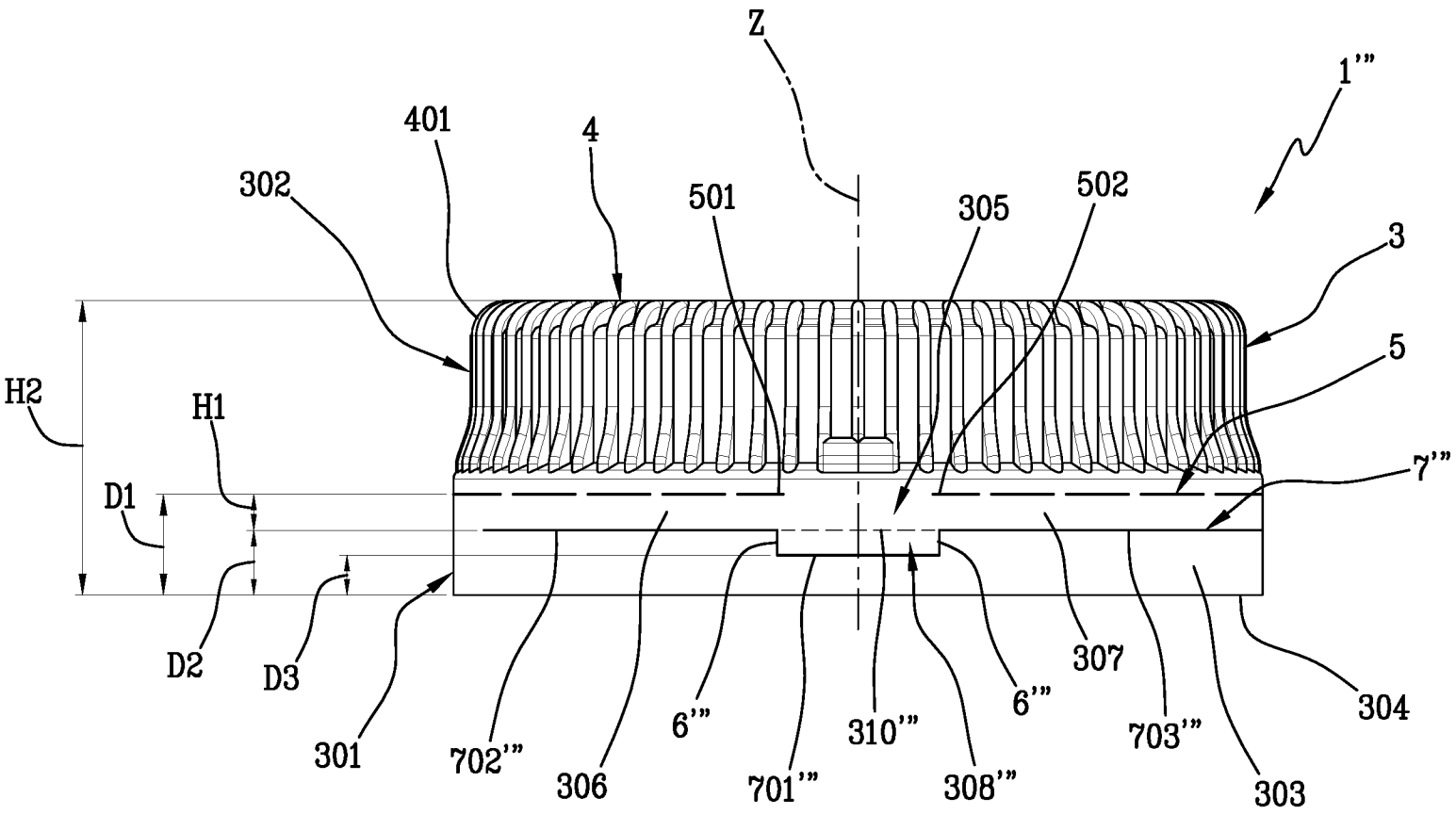
FIG. 8 shows a side view of another version of the cap of FIG. 6, wherein there are the two asymmetrical connecting bands and wherein there is a tab interposed between the two connecting bands, a central stretch of the incision line, designed to form the bottom edge of the tab, protruding towards a free edge of the cap relative to the lateral stretches of the incision line.

According to a variant 1" of the cap shown in FIG. 8, what is stated above for the cap 1 applies but, differently, the cap 1" comprises a tab 308", which differs from the tab 308 of FIGS. 1 to 5 in that there is an incision line 7" which comprises a central stretch 701'" which extends on a second plane, parallel to the separation plane and interposed between the first plane and the free edge 304 of the retaining ring 301, to define a bottom edge of the tab 308" which protrudes relative to the connecting bands 306, 307.

The cap 1" comprises a first lateral section 702" and a second lateral stretch 703'" which are similar to those of FIGS. 6 and 7, that is to say, they have a different length and for which there is the above-mentioned angular difference, and determine connecting bands 306 and 307 of different lengths.

Preferably, according to this variant, the incision line 7" is a through cut line without breakable elements. Optionally, the breakable elements may be present.

The numeral D3 denotes the distance between the central stretch 701" and the free edge 304.

In this case, too, the height of the tab 308" is determined by the height of the cuts 6" which extend from the central stretch 701'" until intercepting the lateral stretches 702'" and 703" but not further. In effect, the tab 308'" is only protruding but does not extend inside the joining zone 305.

Whilst the tab 308" of FIG. 7 is made in the height H1 of the connecting bands 306, 307, the tab 308" of FIG. 8 is made exclusively as an outer part, protruding relative to the first connecting band 306 and the second connecting band 307 and has a hinge line 310''' which is far from the separation line 5.

Unlike the cap 1, and like in the cap 1', the connecting bands 306 and 307 of the cap 1" can deform when the closing element 302 is in the open condition twisting as described above for the cap 1'.

According to a version not illustrated, the cuts 6 may extend from the central stretch 701''' until intercepting the lateral stretches 702''' and 703''', continuing in the joining zone 305 (optionally also in the closing element 302) to give the tab 308" greater flexibility.

According to another variant not illustrated, the joining zone 305 may be provided externally with a projection, projecting from the joining zone 305 and which is positioned between the separation line 5 and the incision line 7, 7', 7" or 7'''.

It should be noted that the projection may advantageously be present in any of the caps 1, 1', 1" and 1" described above so that, when the closing element 302 is in the open condition and the connecting bands 306, 307 keep the closing element 302 connected to the retaining ring 301, the bottom edge defined by the central stretch 701, 701', 701", or 701" of the incision line 7, 7', 7", or 7" faces, in the open condition, towards the dispensing opening of the container and the projection is resting on the neck.

The projection acts in conjunction, in this case, with the tipping of the joining zone 305 and may make the closing element 302 stable and locked on the neck, preventing the connecting bands 306 and 307 from rotating in the opposite direction.

If the caps 1, 1" and 1" comprises the tabs 308, 308" and 308", the projection may extend circumferentially inside the tabs 308, 308" and 308". According to a further variant embodiment, not illustrated, the separation line 5 is positioned between an incision line and the free edge 304. In this case, the retaining ring 301 coincides with the retaining portion 303 and the connecting bands 306, 307 are made in the closing element 302.

The joining zone 305, formed between the first end 501 and the second end 502 of the separation line 5, is joined to the retaining portion 303.

The first connecting band 306 and the second connecting band 307, with different lengths from each other, being angularly of different dimensions the first lateral section 702 and the second lateral section 703 of the incision line 7, when the cap passes from the closed condition to the open condition, they can adopt a shape like a scalene trapezium, not illustrated, but the smaller base of the trapezium faces towards the free edge 304, whilst the larger base of the trapezium, defined by the incision line 7, faces towards the transversal wall 4. In other words, the central stretch of the incision line faces the closing element 302, and in detail, a bottom edge of the closing element 302.

Also in the case of a cap in which the separation line 5 is positioned between the incision line and the free edge 304, it is advantageous that the connecting bands 306, 307 are asymmetrical and that the difference between the connecting bands 306, 307 is as according to the invention as described above.

In use, the cap 1 is applied on the neck 201 of the container 2 in the closed condition. The cap 1 is positioned in such a way that the engagement element 313 provided inside the retaining ring 301, in particular on the retaining portion 303 is below the locking ring 202 present on the neck 201. When the user wishes to open the container 2 for the first time, the user grips the closing element 302 and rotates the closing element 302 about the axis Z, in order to unscrew the closing element 302 from the neck 201 in the opening direction. Initially, the closing element 302 and the retaining ring 301 are rotated together about the axis Z, and they simultaneously move together in a direction parallel to the axis Z, away from the neck 201, engaging the coupling structure of the cap 1 with the corresponding coupling structure 204 of the neck 201 of the container 2.

This occurs until the engagement element 313 of the retaining portion 303 abuts against the locking ring 202 provided on the neck 201. At this point, the locking ring 202 prevents the retaining portion 303 from rising further along the axis Z, acting as a stop for the movement of the retaining portion 303, and therefore of the retaining ring 301, away from the neck 201.

The closing element 302, which is unscrewed by the user, continues to move along the axis Z away from the neck 201. The breakable bridges 503 are thereby tensioned, until causing the failure. The closing element 302 consequently separates from the retaining ring 301 along the separation line 5, but remains joined to the retaining ring 301 at the joining zone 305.

With particular reference to FIGS. 2 to 5, if the user continues to unscrew the closing element 302, so as to move the closing element 302 along the axis Z to remove it from the neck 201, the first connecting band 306 and the second connecting band 307 deform since they extend between the retaining portion 303, locked by the locking ring 202, and the joining zone 305, integral with and joined to the closing element 302, which has moved away from the locking ring 202 and raised upwards.

The first connecting band 306 and the second connecting band 307 are pulled upwards whilst, if present, the breakable elements 704 of the incision line 7 are tensioned, until causing the failure.

Subsequently, the first connecting band 306 and the second connecting band 307 are spaced both from the closing element 302 and from the retaining portion 303 and remain joined to each other in the joining portion 305, thereby adopting a shape like a scalene trapezium whilst the tab 308 is positioned centrally, in the lower base of the trapezium.

The first connecting band 306 remains joined to the retaining portion 303 at an outer end of the first lateral stretch 702 of the incision line 7. Similarly, the second connecting band 307 remains joined to the retaining portion 303 at an outer end of the second lateral stretch 703 of the incision line 7, the outer end of the first lateral stretch 702 and the outer end of the second lateral stretch 703 delimiting externally the incision line 7 circumferentially. Continuing to unscrew the closing element 302, the latter is disengaged from the coupling structure 204, or thread, made on the neck 201, so that the container 2 can be opened. The retaining portion 303 of the retaining ring 301 remains, on the other hand, anchored to the neck 201.

The user can move the closing element 302 in the direction of the shorter connecting band 306 and can rotate the closing element 302 about the joining zone 305 which defines a hinge band in which the hinge elements **305*a* and 305*b* deform to allow the rotation of the closing element 302 relative to the neck 201**.

In the open condition, the tab 308 can be positioned stably resting on the neck 201, the shorter connecting band, that is to say, the first connecting band 306, reinforcing the stability of the open condition.

If, advantageously, the hinge element **305*a* positioned adjacent to the shorter connecting band 306 extends angularly more than the element 305***b*, positioned adjacent to the longer connecting band 307, a robust joining is guaranteed between the closing element 302 and the retaining ring 301 and the possibility that the user uses the cap 1 with numerous cycles of passage from the open condition to the closed condition.

With regard to the cap 1" of FIG. 7, this behaves as already described with reference to the cap 1, also the tab 308" resting stably on the neck 201. On the other hand, with regard to the cap 1' of FIG. 6 and the cap 1'" of FIG. 8, the behaviour of the caps 1', 1'" does not change during the passage in the open condition or in the closed condition with respect to that described above for the cap 1.

However, in the open condition, there is the twisting of the connecting bands 306, 307 as described above with regard to the cap 1' which acts in conjunction with the shorter connecting band to reinforce the stability of the open condition. In the cap 1'", the latter is also reinforced by the presence of the tab 308'" which rests on the neck 301.

In the passage to the closed condition, the user is invited to move the closing element 302 away from the neck 201 moving the closing element 302 from the same part of the shorter connecting band for disengaging the tab 308, or 308'" from the neck 201 of the container 2, in the case of caps 1, 1" and 1'". For the cap 1' and also for the cap 1'", in addition to having to disengage the tab 308'", the user must twist the joining zone 305 which was turned over in the passage to the open condition.

Thanks to the fact that the longest connecting band is present, the user is able to use this greater length for pulling and bending the connecting band in such a way as to be facilitated in rotating again the closing element 302 returning it above the dispensing opening 203.

The caps 1, 1', 1" and 1" described above are made of plastic material, for example polypropylene (PP) or polyethylene (PE).

If PE is used, its density may range from low density to high density. More specifically, it is possible to use high-density polyethylene (HDPE).

The high-density polyethylene (HDPE) used to produce the caps described above can have the following properties:

density variable between 950 and 968 kg/m3;

melt index variable from 0.3 to 20 g, under the following measurement conditions: 10 minutes, 190° C., 2.16 kg;

large, or narrow, or unimodal, or multi-modal distribution of molecular weight.

If PP is used, the material may be in the form of a homopolymer, or heterophasic copolymer, or statistical copolymer.

The fluidity index of the PP may vary from 2 to 20 g, under the following measurement conditions: 10 minutes, 230° C., 2.16 kg.

The invention claimed is:

1. A closing cap (1; 1'; 1"; 1'") for a container (2), comprising a lateral wall (3) extending around an axis (Z) and a transversal wall (4) positioned at one end of the lateral wall (3), a separation line (5) being provided on the lateral wall (3) to define a retaining ring (301), which comprises a retaining portion (303) which extends as far as a free edge (304) of the retaining ring (301) and is configured to internally engage with a locking ring (202) of a neck (201) of the container (2) in such a way as to remain anchored to the neck (201), and a closing element (302) removably engageable with the neck (201), so as to open or close the container (2) by rotating the closing element (302) around the axis (Z); the separation line (5) being circumferentially interrupted to define in the lateral wall (3) a joining zone (305) in which the retaining ring (301) and the closing element (302) are joined; the cap additionally comprising an incision line (7; 7'; 7"; 7'"), which is also provided on the lateral wall (3) to define, together with the separation line (5) at least a first connecting band (306) and a second connecting band (307) for connecting the joining zone (305) and the retaining portion (303) to each other; wherein the incision line (7; 7'; 7"; 7'") comprises a pair of lateral stretches (702, 703; 702', 703'; 702", 703"; 702'", 703'") wherein a first lateral stretch of the pair of lateral stretches (702; 702'; 702"; 702'") defines, with a first part of the separation line (5) which extends from a first end (501) of the separation line (5), the first connecting band (306) and a second lateral stretch of the pair of lateral stretches(703; 703'; 703"; 703'") defines, with a second part of the separation line (5) which extends from a second end (502) of the separation line (5), the second connecting band (307); wherein the first and second lateral stretches (702, 703; 702', 703'; 702", 703"; 702'", 703'") have different angular extents to define the connecting bands (306; 307) having different lengths, the angular difference between the longer of the first and second lateral stretches and the other of the first and second lateral stretches being greater than, or equal to 5° and less than, or equal to 45°.

2. The cap according to claim 1, wherein the angular difference between the longer of the first and second lateral stretches and the other of the first and second lateral stretches is greater than or equal to 10° and less than or equal to 30°.

3. The cap according to claim 1, wherein a longer of the first and second connecting bands is located in a direction of opening, in which the closing element (6) can be rotated to open the container (2), to facilitate a passage of the cap (1; 1'; 1"; 1'") from the closed condition to the open condition.

4. The cap according to claim 1, wherein a longer of the first and second connecting bands is located in a direction of closing, in which the closing element (6) can be rotated to close the container (2), to facilitate a passage of the cap (1; 1'; 1"; 1'") from the open condition to the closed condition.

5. The cap according to claim 1, wherein the incision line (7; 7'; 7"; 7'") is positioned between the separation line (5) and the free edge (304) and additionally comprises a central stretch (701; 701'; 701"; 701'"), positioned between the first lateral stretch (702; 702'; 702"; 702'") and the second lateral stretch (703; 703'; 703"; 703"); the central stretch (701; 701'; 701"; 701'") having an end edge (309) configured to be directed, when the cap is in the open condition, towards the neck (201), or towards the supply opening (203), of the container (2).

6. The cap according to claim 5, wherein the cap (1; 1"; 1'") comprises a tab (308; 308"; 308'") whose end edge (309) is formed by the central stretch (701; 701"; 701'") of the incision line (7; 7"; 7'") and whose lateral edges (311) are formed by two cuts (6; 6"; 6'") which extend from the central stretch (701; 701"; 701'") towards the closing element (302), the cuts (6; 6"; 6'") being formed by cuts passing through an entire thickness of the lateral wall (3).

7. The cap according to claim 6, wherein the first lateral stretch (702; 702") and the second lateral stretch (703; 703") of the incision line (7; 7") are aligned with each other and lie in a first plane parallel to a separation plane in which the separation line (5) lies; and wherein the central stretch (701; 701") lies in the same first plane to form the tab (308; 308") wherein the end edge (309) is aligned with the connecting bands (306; 307).

8. The cap according to claim 6, wherein the first lateral stretch (702'") and the second lateral stretch (703'") of the incision line (7''') are aligned with each other and lie in a first plane parallel to a separation plane in which the separation line (5) lies; and wherein the central stretch (701''') lies on a second plane parallel to the separation plane and parallel to the first plane to form the tab (308''') wherein the end edge (309) protrudes with respect to the connecting bands (306; 307).

9. The cap according to claim 1, wherein along the separation line (5) there can be a plurality of breakable bridges (503) and optionally along the incision line (7), there can be a plurality of breakable elements (704), the breakable bridges (503) and breakable elements (704) being designed to break the first time the cap (1; 1"; 1"; 1''') is opened.

10. The cap according to claim 6, wherein the joining zone (305) defines a hinge band which comprises a first hinge element (305*a*; 305*a*") and a second hinge element (305*b*; 305*b*") positioned at the sides of the tab (308; 308") configured to deform in the open condition, which are defined at least partly in the joining zone (305) respectively between the first end (501) and the second end (502) of the separation line (5) and respective upper ends of the cuts (6; 6"); wherein the hinge element (305*a*; 305*a*"; 305*b*; 305*b*") adjacent to a shorter of the first and second connecting bands (306; 307) extends angularly about the axis (Z) further than the other hinge element (305*b*; 305*b*"; 305*a*; 305*a*") adjacent to a longer of the first and second connecting bands.

11. The cap according to claim 10, wherein the first lateral stretch (702; 702") and the second lateral stretch (703; 703") of the incision line (7; 7") are aligned with each other and lie in a first plane parallel to a separation plane on which the separation line (5) lies, along said separation plane the different angular extension between the first hinge element (305*a*; 305*a*") and the second hinge element (305*b*; 305*b*") determines a respective difference in length which is greater than or equal to 0.10 mm and is less than or equal to 0.20 mm.

12. The cap according to claim 10, wherein the first lateral stretch (702; 702") and the second lateral stretch (703; 703") of the incision line (7; 7") are aligned with each other and lie in a first plane parallel to a separation plane on which the separation line (5) lies, along said separation plane the different angular extension between the first hinge element (305*a*; 305*a*") and the second hinge element (305*b*; 305*b*") determines a respective difference in length which is equal to 0.15 mm.

* * * * *